US005890253A

United States Patent [19]

Morad

[11] Patent Number: 5,890,253

[45] Date of Patent: Apr. 6, 1999

[54] MOP APPARATUS FOR UNWINDING THE TANGLED STRANDS OF A MOP HEAD

[75] Inventor: Fred I. Morad, Toluca Lake, Calif.

[73] Assignee: Worldwide Integrated Resources, Inc., Glendale, Calif.

[21] Appl. No.: 987,530

[22] Filed: Dec. 9, 1997

[51] Int. Cl.[6] ..... A47L 13/142

[52] U.S. Cl. ..... 15/120.1; 15/120.2

[58] Field of Search ..... 15/116.1, 119.1, 15/120.1, 120.2

[56] References Cited

U.S. PATENT DOCUMENTS

| | | | |
|---|---|---|---|
| 1,218,618 | 3/1917 | Bauer | 15/120.1 |
| 1,426,440 | 8/1922 | Zieschang | 15/119.1 |
| 1,514,051 | 11/1924 | Jumonville | 15/120.2 |
| 1,710,190 | 4/1929 | Regan | 15/120.2 |
| 2,066,096 | 12/1936 | Currie | 15/120.2 |
| 2,230,101 | 1/1941 | Bakemeier | 15/120.2 |
| 2,365,437 | 12/1944 | Schaefer | 15/120.2 |
| 4,464,807 | 8/1984 | Weiss | 15/119.2 |
| 5,509,163 | 4/1996 | Morad | 15/120.2 |
| 5,722,105 | 3/1998 | Thomasson | 15/120.2 |

*Primary Examiner*—Mark Spisich
*Assistant Examiner*—Theresa T. Snider
*Attorney, Agent, or Firm*—Thomas I. Rozsa; Tony D. Chen; Jerry Fong

[57] ABSTRACT

A mop apparatus for unwinding the tangled strands of a mop head such that the strands of the mop head are disentangled. The apparatus includes an inner member, an outer member slidably installed over the inner member, and a mop head which is made from a plurality of strands attached between lower ends of the inner and outer members. The outer member has a spiral ridge which is located on the lowermost portion of the outer member and a gripping portion which is located at the uppermost portion of the outer member. A ring sleeve member fits around the lowermost portion of the outer member and around the spiral ridge. A plurality of mating grooves are located inside the interior wall of the ring sleeve member to mate with the spiral ridge on the lowermost portion of the outer member. Alternatively, the outer member may have a spiral groove and the ring sleeve may have a corresponding spiral ridge. By allowing the ring sleeve member to move upwardly and travel along the spiral ridge in an upward fashion from a lower position to an upper position, then the entire mop head goes around and disentangles the mop strands. A user holds the ring sleeve member at the lower position, where the inner member, the outer member and the mop head start rotating clockwise. The rotational movement of the mop head disentangles the mop strands from each other.

29 Claims, 4 Drawing Sheets

FIG.1
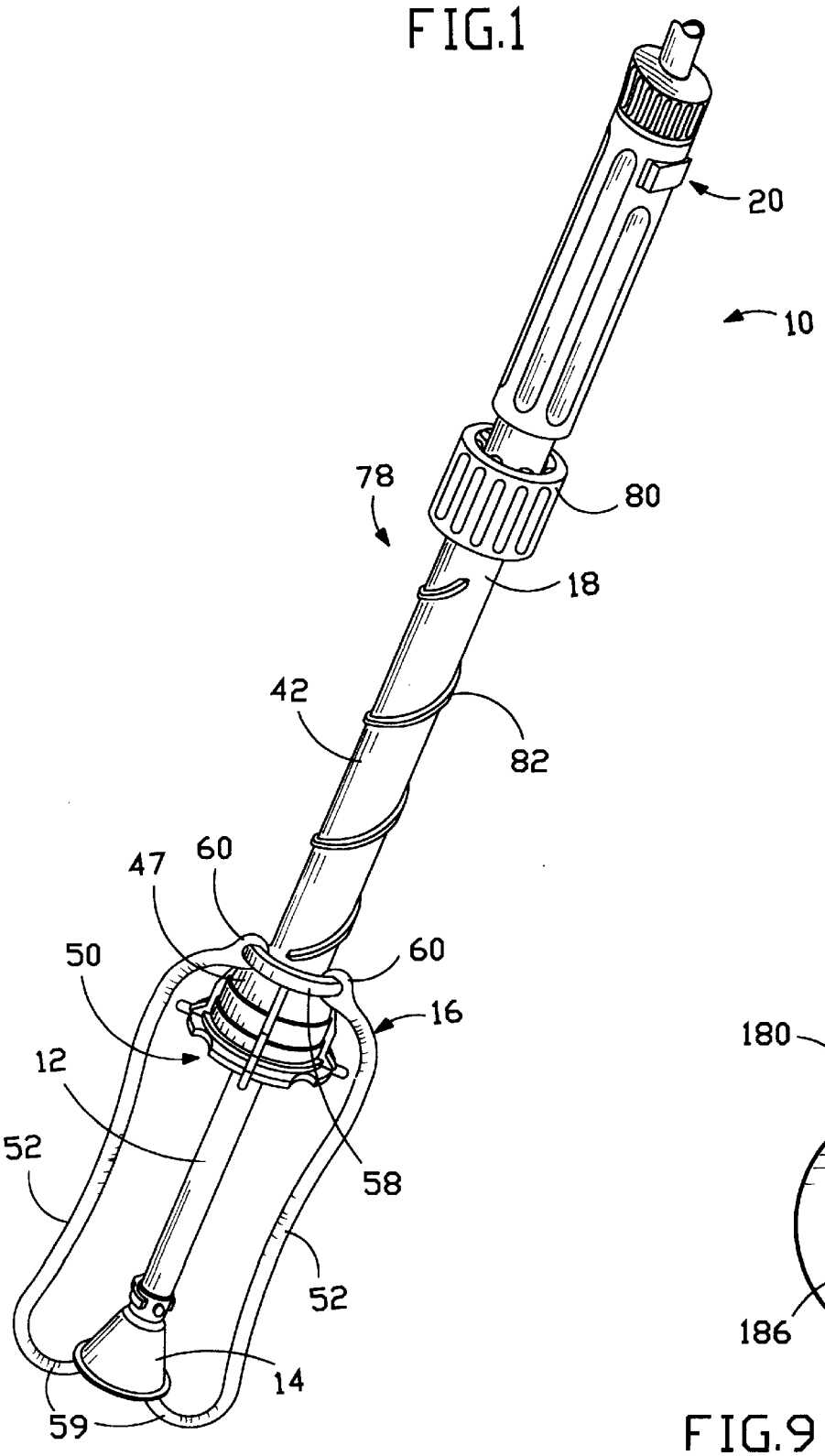
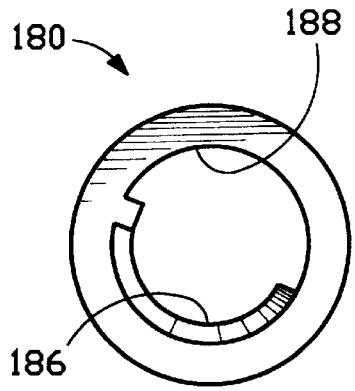
FIG.9

FIG.4
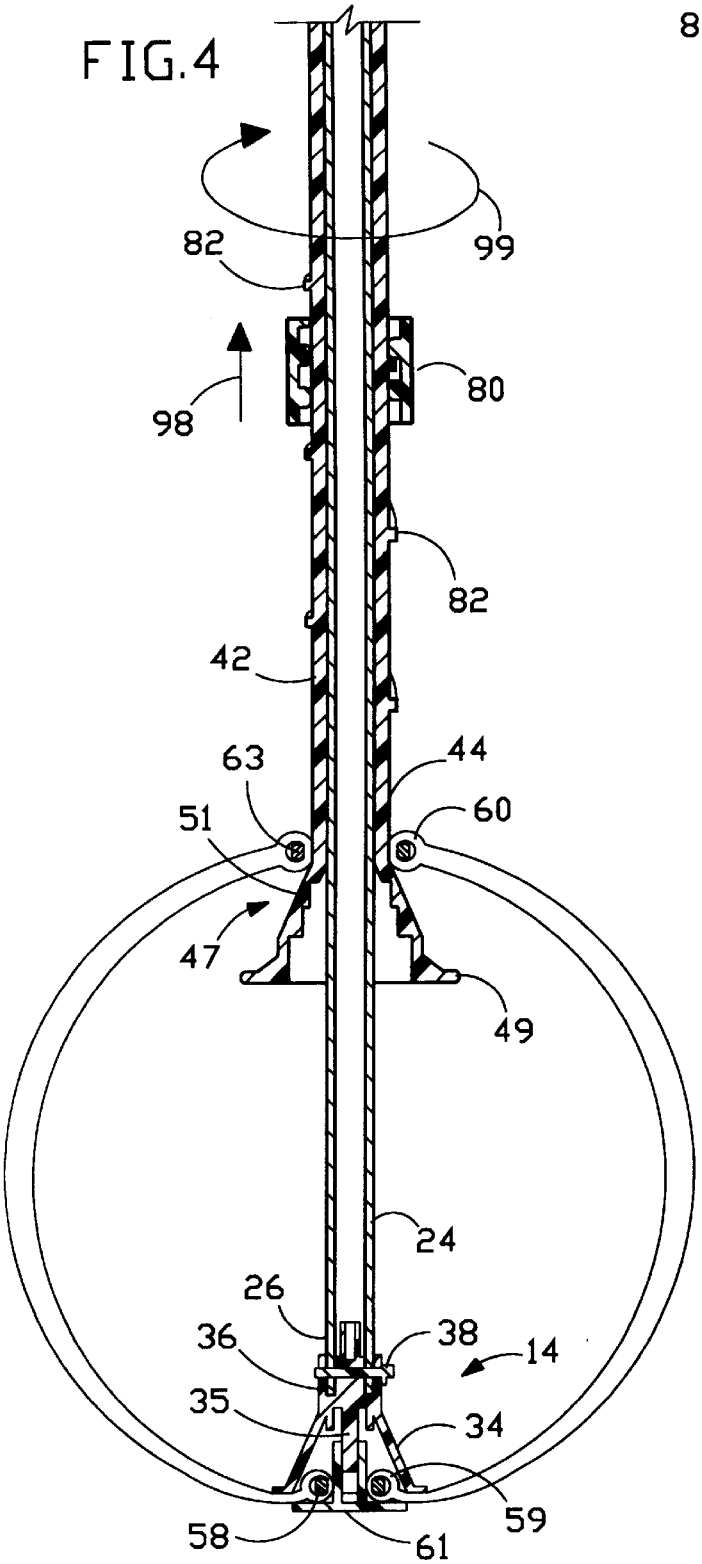
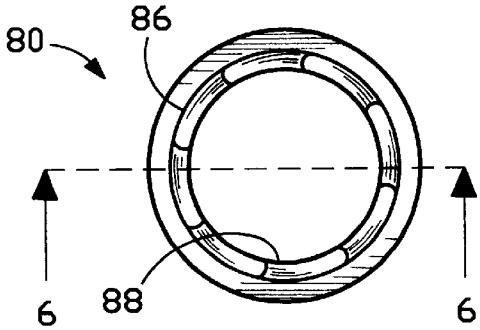
FIG.5
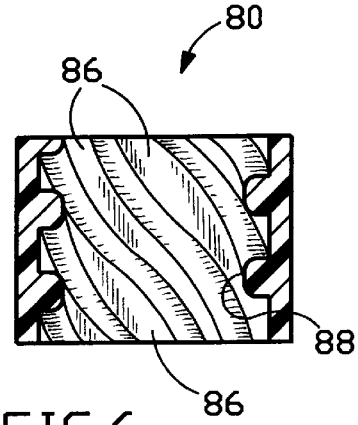
FIG.6

MOP APPARATUS FOR UNWINDING THE TANGLED STRANDS OF A MOP HEAD

BACKGROUND OF THE INVENTION

1. Field of the Invention

The present invention generally relates to the field of mops. More particularly, the present invention relates to the field of self-wringing mops for unwinding the tangled strands of a mop head.

2. Description of the Prior Art

Specifically, self-wringing mops are currently being used in general households and ordinary businesses or institutions. These self-wringing mops are mops wherein after the mop is used to clean a floor, it is dipped in the cleaning water or fluid and thereafter, twisted so that the mop strands can be wrung together and wring the water out of the strands. One problem is that the mop strands frequently become tangled together. When the mop strands become tangled, a user must use his or her hands to untangle the mop stands. The disadvantage with this is that its takes a long time to untangle the strands from each other and also the user must use his or her hands to untangle the soiled mop.

The following seven (7) prior art patents are found to be pertinent to the field of the present invention:

1. U.S. Pat. No. 1,218,618 issued to Bauer on Mar. 13, 1917 for "Combined Mop And Wringer" (hereafter the "Bauer Patent");
2. U.S. Pat. No. 1,710,190 issued to Regan on Apr. 23, 1929 for "Combined Mop Holder And Wringer" (hereafter the "Regan Patent");
3. U.S. Pat. No. 2,066,096 issued to Currie on Dec. 29, 1936 for "Floor Mop" (hereafter the "Currie Patent");
4. U.S. Pat. No. 2,230,101 issued to Bakemeier on Jan. 28, 1941 for "Mop Holder And Wringer" (hereafter the "Bakemeier Patent");
5. U.S. Pat. No. 2,365,437 issued to Schaefer on Dec. 19, 1944 for "Mop" (hereafter the "Schaefer Patent");
6. U.S. Pat. No. 4,464,807 issued to Weiss on Aug. 14, 1984 for "Floor Mop" (hereafter the "Weiss Patent"); and
7. U.S. Pat. No. 5,509,163 issued to Morad on Apr. 23, 1996 for "Quick Squeezing Wringable Mop" (hereafter "the Morad Patent").

The Bauer Patent discloses a combined mop and wringer. It comprises an operating mechanism for imparting a rotary movement to one of the mop holding members whereby the initial twisting of the mop is effected at a comparatively rapid rate and the final twisting is accomplished by a slower and more powerful twisting movement.

The Regan Patent discloses a combined mop holder and wringer. It comprises a handle with a mop clamp at a lower end of the handle. Slidably mounted on the handle is a tubular sleeve, on the lower end of which is secured a loop mop holder. A reduced portion is located between the mop clamp and the loop mop holder, where a mop is wrapped around the reduced portion and held there by the mop clamp and the loop mop holder. A helical-shaped groove is formed in the surface of the handle and extends substantially from the upper end to the tubular sleeve. This helical-shaped groove, together with a sleeve nut serves the function of imparting a rotary movement to the handle when the mop is to be wrung, this being accomplished by sliding the sleeve nut along the handle from the upper end of the handle to the lower end of the handle. The sleeve nut held by one hand and pulled downwardly on the handle while the tubular sleeve is grasped by the other hand. The sleeve nut is tightly gripped when it is pulled downwardly over the handle and a rotary movement is thus transmitted to the handle, and as the mop clamp is secured to the lower end of the handle, it will rotate with the handle while the loop which is secured to the tubular sleeve is held stationary with the other hand.

The Currie Patent discloses a floor mop. It comprises a handle with an open ended tube which serves as a cylinder to accommodate a reciprocatory plunger. The plunger has a head which is slidably fitted within the cylinder. The head of the plunger is a bearing to accommodate a rotary jointing knob on the inner end of a mop turning screw. Attached to the bottom of the handle is a stationary plate with a guide slot through which the mop turning screw works back and forth. This forms the means for converting the reciprocatory motion of the plunger into the rotary motion for an adapter fixture attached to the lower end of the mop turning screw.

The Bakemeier Patent discloses a mop holder and wringer. It comprises a handle which is formed with a longitudinal channel extending from the lower end to a major portion of the handle and communicates with a spiral extension. Mounted on the handle is a metal sleeve which serves as a hand hold. The sleeve has an inner bearing ball which enters the channel, causing the handle and the sleeve to rotate together, but when the sleeve is raised, this causes the ball to enter the spiral groove. The handle rotates when the sleeve is held to keep the sleeve from turning.

The Schaefer Patent discloses a mop. It comprises a handle with a mop secured at its lower end and a fabric stretching and wringing mechanism. The mechanism has a body portion in the form of a sleeve with an external spiral slot. Secured in a predetermined position on the mop handle is a pin or screw on which a roller head is rotatably mounted. The roller head sits on the handle and projects into the spiral groove of the sleeve so that when the sleeve is slidably moved on the mop handle, the sleeve is caused to rotate due to the coaction of the roller head working in the spiral groove of the sleeve.

The Weiss Patent discloses a floor mop which comprises a handle and a helicoidal screw-threaded groove.

The Morad Patent discloses a quick squeezing wringable mop which utilizes a spring-and-ratchet mechanism and longitudinal ribs on the handle.

It is desirable to have a very efficient and also very effective design and construction of a mop apparatus for unwinding a tangled mop head. It is also desirable to provide a mop apparatus for unwinding a tangled mop head with the capability of rapidly untangling mop strands without getting the user's hands soiled and not to spend enormous amount of time to untangle the strands from each other.

SUMMARY OF THE INVENTION

The present invention is a mop apparatus for unwinding the tangled strands of a mop head so that the strands of the mop head are untangled. The mop apparatus comprises an inner tubular member, an outer tubular member slidably installed over the inner tubular member, and the mop head attached between the lower ends of the inner and outer tubular members.

The outer tubular member has an elongated spiral ridge which is located on the lowermost portion and a gripping portion which is located at the uppermost portion. The spiral ridge may be a female imbedded spiral groove.

A ring sleeve member fits around the lowermost portion of the outer tubular member and around the spiral ridge. A plurality of mating spiral grooves are located inside the interior wall of the ring sleeve member. These mating spiral grooves are designed to engage with the spiral ridge on the lowermost portion of the outer tubular member.

The object of the present invention is that by allowing the ring sleeve member to move upwardly and travel along the spiral ridge in an upward fashion from a lower position to an upper position, then the entire mop head rotates which in turn disentangles the mop strands. A user only holds the ring sleeve member at the lower position, the inner tubular member, the outer tubular member and the mop head will all rotate clockwise to untangle the mop head. The rotational movement of the mop head disentangles the mop strands from each other.

It is an object of the present invention to provide a mop apparatus which comprises an inner tubular member, an outer tubular member slidably installed over the inner tubular member, and a mop head which is made from a plurality of strands attached on respective retaining means on the inner and outer tubular member so that the strands extend between lower ends of the inner and outer tubular member. A ring sleeve member is fitted around the outer tubular member and has a plurality of interior spiral grooves. One of the spiral grooves on the ring sleeve member engages with a spiral ridge on the outer tubular member such that the ring sleeve member is allowed to travel upwardly along the spiral ridge in an upward fashion to unwind the mop strands.

It is a further object of the present invention to provide a mop apparatus which further comprises a spring biased pawl pivotally mounted on the outer tubular member, so that the pivoted pawl is biased by a spring means to engage with one of the longitudinal ribs on the inner tubular member for locking the rotational movement of the outer tubular member. Therefore, a user can simply press the pawl against the spring means to disengage it from the longitudinal ribs of the inner tubular member to unlock the rotational movement of the outer tubular member and allow the mop to unwind for use.

In the preferred embodiment of the present invention, the mop apparatus comprises an inner tubular member, an outer tubular member slidably installed over the inner tubular member, and a mop head attached between lower ends of the inner and outer tubular members. A spiral ridge is formed on the lowermost portion of the outer tubular member, where one of a plurality of spiral grooves on a ring sleeve member engages with the spiral ridge to allow the sleeve member to travel upwardly along the spiral ridge in an upward fashion to unwind the mop head.

In an alternative embodiment of the present invention, the mop apparatus comprises an inner tubular member, an outer tubular member slidably installed over the inner tubular member, and a mop head attached between lower ends of the inner and outer tubular members. A spiral groove is formed on the lowermost portion of the outer tubular member, where a spiral ridge on a ring sleeve member engages with the spiral groove to allow the sleeve member to travel upwardly along the spiral groove in an upward fashion to unwind the mop head.

Further novel features and other objects of the present invention will become apparent from the following detailed description, discussion and the appended claims, taken in conjunction with the drawings.

BRIEF DESCRIPTION OF THE DRAWINGS

Referring particularly to the drawings for the purpose of illustration only and not limitation, there is illustrated:

FIG. 1 is a perspective view of the preferred embodiment of the present invention mop apparatus for unwinding a tangled mop head;

FIG. 4 is a longitudinal cross-sectional view of the present invention mop apparatus shown in FIG. 1, showing one of the spiral grooves on the ring sleeve member engaging the spiral ridge;

FIG. 5 is a top plan view of a ring sleeve member of the present invention mop apparatus shown in FIG. 1;

FIG. 6 is a cross-sectional view taken along line 6—6 of FIG. 5;

FIG. 9 is a top plan view of the ring sleeve member shown in FIG. 8.

DESCRIPTION OF THE PREFERRED EMBODIMENT

Figure 2:
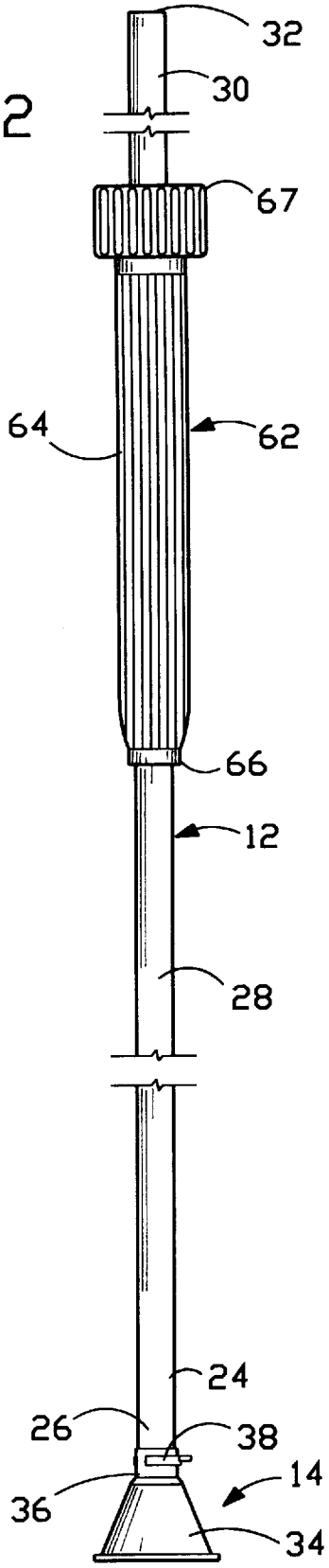
FIG. 2 is a side elevational view of an inner tubular member of the present invention mop apparatus shown in FIG. 1.

Although specific embodiments of the present invention will now be described with reference to the drawings, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention as further defined in the appended claims.

Referring to FIG. 1, there is depicted at 10 the present invention apparatus which is a self-wringing mop for unwinding the tangled strands on the mop head 16. The self-wringing mop 10 comprises an elongated inner tubular member 12, a hollow outer tubular member 18, a first retaining member 14, a second retaining member 47, a mop head 16 (comprising a multiplicity of mop strands, two of which are illustrated at 52) a spring-and ratchet mechanism 20, and a disentangling mechanism 78.

Referring to FIGS. 1, 2 and 4, the inner tubular member 12 comprises a proximal section 24 with a proximal end 26, a middle section 28, and a distal section 30 with a distal end 32. The first retaining member 14 comprises a cone shaped portion 34, an upper stem portion 35 protruding upwardly from a bottom of the cone shaped portion 34, and a lower receiving portion 36. The first retaining member 14 is detachably installed to the inner tubular member 12 by inserting the lower receiving portion 36 onto the proximal end 26 of the inner tubular member 12 and secured thereto by transversely inserting a C-shaped fastener 38 through the lower receiving portion 36 and the proximal end 26 of the inner tubular member 12.

Figure 3:
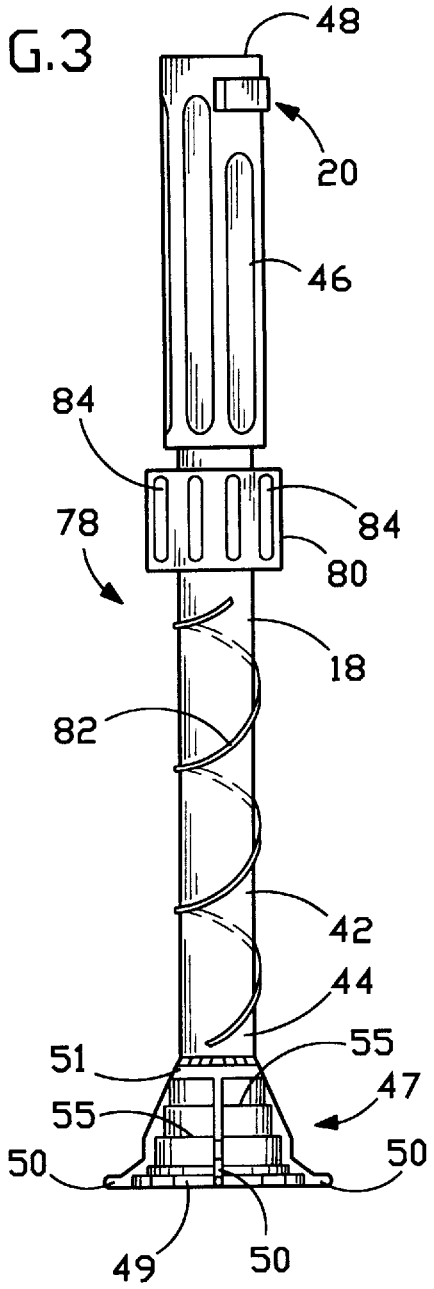
FIG. 3 is a side elevational view of an outer tubular member of the present invention mop apparatus shown in FIG. 1.

Referring to FIGS. 1 and 3, the outer tubular member 18 is disposed around the middle, proximal section 28 of the inner tubular member 12 and movable longitudinally and rotatable with respect to the inner tubular member 12. The outer tubular member 18 comprises a proximal section 42 with a proximal end 44 and a distal handle section 46 with a distal end 48. The second retaining member 47 comprises a cone shaped portion 49 and an attachment portion 51 which is integrally formed with the proximal end 44 of the outer tubular member 18. The cone shaped portion 49 comprises a plurality of spaced apart longitudinal ribs 50 and a plurality of spaced apart transverse ribs 55 which are integrally formed thereto.

For clarity only, FIG. 1 illustrates only two opposite mop strands 52 of the mop head 16. It will be appreciated that a conventional mop head 16 comprises a multiplicity of strands 52 for mopping. These mop strands 52 are conventionally attached to the first and second retaining members 14 and 47. By way of example only, an annular tie-strap 58 which is conventional may tie down the first ends 59 of the mop strands 52 to the first retaining member 14 and is secured thereto by a tap cover 61 which is press-fitted to the upper stem portion 35 of the first retaining member 14 and covers the opening of the cone shaped portion 34 of the first retaining member 14 (see FIG. 4). By way of example only, another annular tie-strap 63 which is conventional may tie down the second ends 60 of the mop strands 52 which are disposed around the cone shaped portion 49 of the second retaining member 47. The cone shaped portion 49 prevents displacement of the annular tie member 63 because of its outwardly tapered surface. The longitudinal ribs 50 and the transverse ribs 55 on the cone shaped portion 49 of the second retaining member 47 further prevent the rotation of the mop head 16 with respect to the proximal section 42 of the outer tubular member 18.

Referring to FIGS. 1, 2 and 3, there is shown the spring-and rachet mechanism 20. The description of the spring-and-ratchet mechanism will be discussed in general terms. A gear sleeve member 62 is press-fitted on the inner tubular member 12 and located adjacent to the middle section 28 and the distal section 30. The gear sleeve member 62 comprises a tapered first end 66, a stop knob second end 67, and a plurality of spaced apart longitudinal ribs 64 between the first end 66 and the second ends 67. The sleeve member 62 is similar to a gear wheel which extends all around the inner tubular member 12. The longitudinal ribs 64 on the gear sleeve member 62 are utilized for the spring-and-ratchet mechanism 20.

The spring-and-ratchet mechanism 20 may comprise a spring biased pawl which has an inner claw portion. The spring biased pawl is pivotally mounted in a side slot on the distal handle section 46 of the outer tubular member 18 and retained by a pin fastener. The pawl is located adjacent to the distal end 48 and biased by a spring means such that its tip is engaged with one of the plurality of longitudinal ribs 64 of the gear sleeve member 62 to prevent the outer tubular member 18 from springing back to its initial position. This spring-and-ratchet mechanism 20 is used for locking the rotational motion of the outer tubular member 18. The rotational motion of the outer tubular member 18 is governed by the spring-and-ratchet mechanism 20. When the outer tubular member 18 is rotated in its clockwise circular path, which squeezes the mop strands 52 of the mop head 16, the outer tubular member 18 can stop at any position relative to the inner tubular member 12 and the outer tubular member 18 can be released without causing the mop head 16 to unwind. Therefore, a user can simply press the pawl against the spring means to disengage it from one of the plurality of longitudinal ribs 64 of the gear sleeve member 62 to unlock the rotational movement of the outer tubular member 18, thereby allowing the outer tubular member 18 to automatically and rapidly spring back to its initial position and unwind the mop head 16 for subsequent mopping use. The pawl will hold the outer tubular member 18 at any given position and at such time can be released by the user. To unwind the mop head 16, the user can simply press the pawl against the spring means to disengage it from one of the plurality of longitudinal ribs 64 of the gear sleeve member 62 to unlock the rotational movement of the outer tubular member 18 so that the mop head 16 will unwind.

The outer tubular member 18 is normally rotated in the clockwise direction for wringing the mop head dry. The outer tubular member 18 cannot rotate in the counter-clockwise direction because of the spring-and-ratchet mechanism 20 which is a one-way ratchet mechanism which prevents this from occurring. When the pawl is pressed, the outer tubular member 18 is released in the counter-clockwise direction, which in turn unwinds the mop head 16 for use. It will be appreciated that the outer tubular member 18 can be constructed to rotate in the counter-clockwise direction by reversing the position of the spring-and-ratchet mechanism 20 in the opposite direction and reversing the longitudinal ribs 64 on the gear sleeve member 62, without departing from the spirit and scope of the present invention.

When a user stops applying a rotational force to the outer tubular member 18 at any given time and releases the outer tubular member 18, the spring-and-ratchet mechanism 20 will lock the outer tubular member 18, and thereby not allow the mop head 16 to unwind. When the pawl is pressed against the spring means to disengage it from one of the plurality of longitudinal ribs 64 of the gear sleeve member 62, this action hereby unlocks the rotational movement of the outer tubular member 18 and allows the mop head 16 to unwind for use.

Referring to FIGS. 1, 3 and 4, there is depicted the disentangling mechanism 78 which is incorporated with the mop apparatus 10. The disentangling mechanism 78 comprises a ring sleeve member 80 and an elongated spiral ridge or guide 82 which is a male type configuration. The spiral ridge 82 is integrally formed on the proximal section 42 of the outer tubular member 18. The ring sleeve member 80 fits around the proximal section 42 of the outer tubular member 18 and around the spiral ridge 82. The ring sleeve member 80 has a plurality of exterior knurls 84 so that the ring sleeve member 80 can be grabbed and moved upward by the motion of a user's hand. A plurality of spiral grooves or guides 86 are located inside the interior wall 88 of the ring sleeve member 80. These spiral grooves 86 are a female type configuration and are designed to mate with the spiral ridge 82 on the proximal section 42 of the outer tubular member 18. Arrow 98 depicts the direction in which the ring sleeve member 80 must travel to disentangle the mop head 16. Arrow 99 depicts the rotational direction in which the inner tubular member 12, the outer tubular member 18 and the mop head 16 rotate when the ring sleeve member 80 is moving upwardly.

The disentangling mechanism 78 allows the ring sleeve member 80 to travel upwardly along the spiral ridge 82 in an upward fashion from a lower position to an upper position, so that the entire mop head 16 rotates and disentangles the mop strands 52. A user only holds the ring sleeve member 80 at the lower position which is adjacent to the proximal end 44 of the outer tubular member 18, where the inner tubular member 12, the outer tubular member 18 and the mop head 16 start rotating clockwise. The rotational movement of the mop head 16 will disentangle the mop strands 52 from each other. By allowing the ring sleeve member 80 to travel along the spiral ridge 82, the entire mop apparatus 10 rotates and the mop strands 52 are disentangled from each other.

Figure 7:
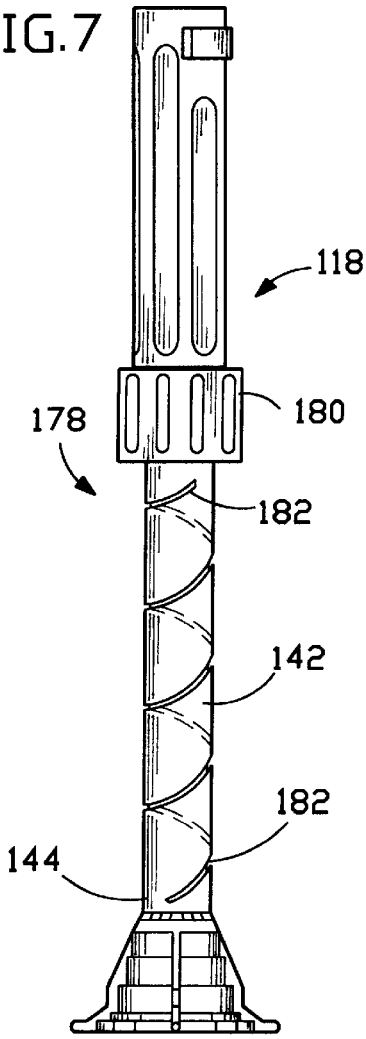
FIG. 7 is a side elevational view of an alternative embodiment of the outer tubular member of the present invention mop apparatus.

Referring to FIG. 7, there is depicted an alternative embodiment of the present invention mop apparatus 110. In this embodiment, the disentangling mechanism 178 assembles and functions similar to the disentangling mechanism 78 previously described above in FIGS. 1 through 6, and the only difference is the nature and configuration of the disentangling mechanism 178. Only the modified parts will be described in detail. All of the parts are numbered correspondingly with 100 added to each number.

Figure 8:
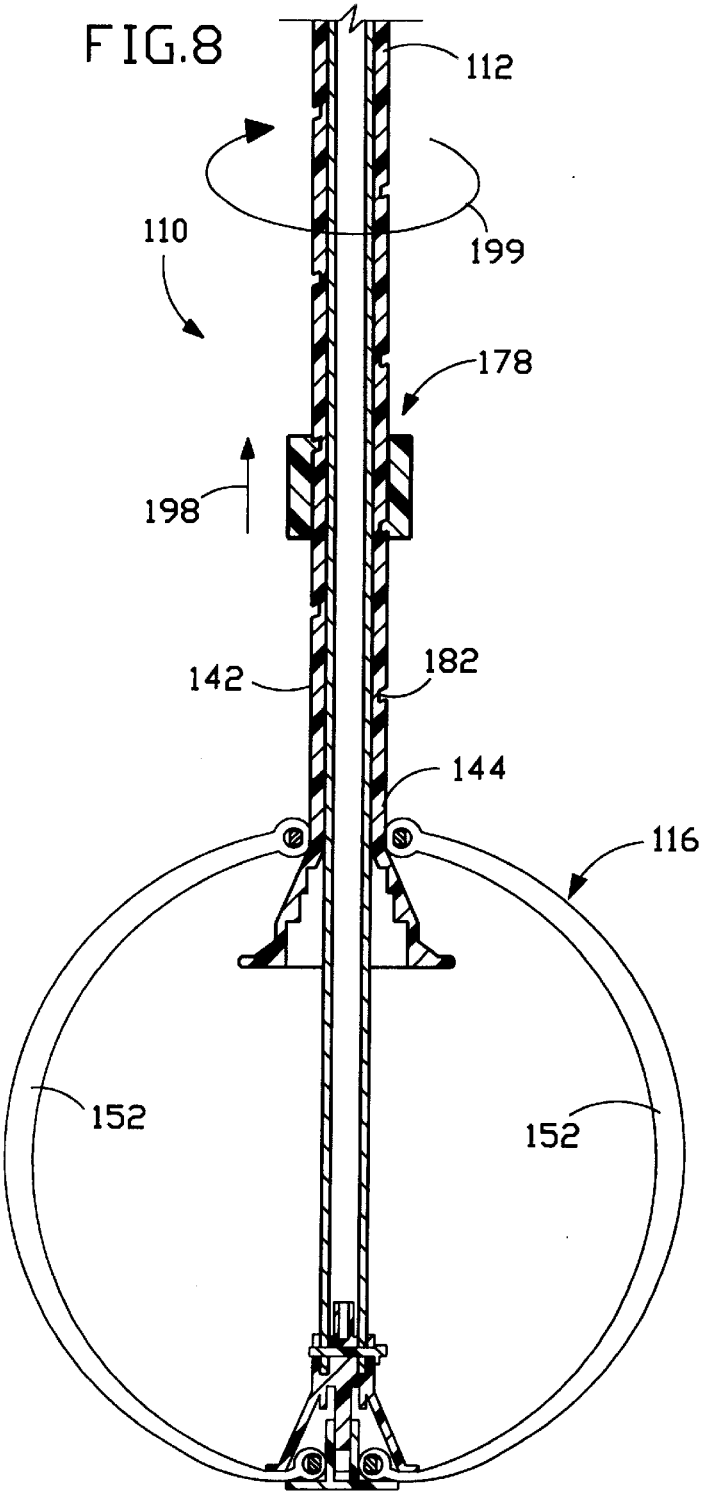
FIG. 8 is a longitudinal cross-sectional view of an alternative embodiment of the present invention mop apparatus, showing a spiral ridge on the ring sleeve member engaging the spiral groove on the outer tubular member.

Referring to FIGS. 7, 8 and 9, the disentangling mechanism 178 is incorporated with the mop apparatus 110. The disentangling mechanism 178 comprises a ring sleeve member 180 and an elongated spiral groove or guide means 182 which is a female type configuration. The spiral groove 182 is integrally formed on the proximal section 142 of the outer tubular member 118. The ring sleeve member 180 fits around the proximal section 142 of the outer tubular member 118 and around the spiral groove 182.A corresponding spiral ridge 186 is located inside the interior wall 188 of the ring sleeve member 180. This corresponding spiral ridge 186 is a male type configuration and is designed to mate with the spiral groove 182 on the proximal section 142 of the outer tubular member 118. Arrow 198 depicts the direction in which the ring sleeve member 180 must travel to disentangle the mop head 116. Arrow 199 depicts the rotational direction in which the inner tubular member 112, the outer tubular member 118 and the mop head 116 rotate when the ring sleeve member 180 is moving upwardly.

The disentangling mechanism 178 allows the ring sleeve member 180 to travel upwardly along the spiral groove 182 in an upward fashion from a lower position to an upper position, so that the entire mop head 116 rotates and disentangles the mop strands 152. A user only holds the ring sleeve member 180 at the lower position which is adjacent to the proximal end 144 of the outer tubular member 118, where the inner tubular member 112, the outer tubular member 118 and the mop head 116 start rotating clockwise. The rotational movement of the mop head 116 will disentangle the mop strands 152 from each other. By allowing the ring sleeve member 180 to travel along the spiral groove 182, the entire mop apparatus 110 rotates and the mop strands 152 are disentangled from each other.

While the embodiment as shown shows the sleeves 80 and 180 traveling upwardly along the outer shaft, it will be appreciated that the sleeve can also be designed to travel downward along the outer shaft to disentangle the mop strands.

Defined in detail, the present invention is a mop apparatus for unwinding the tangled strands of a mop head which is made from a plurality of strands, the apparatus comprising: (a) an elongated inner tubular member having a proximal section with a proximal end and a distal section with a distal end; (b) a first retaining means attached to the proximal end of the inner tubular member for retaining first ends of the plurality of strands; (c) an outer tubular member slidably installed over the proximal section of the inner tubular member and having a proximal section with a proximal end, a distal handle section, and an elongated spiral ridge integrally formed on the proximal section and extending downwardly from a midsection to the proximal end; (d) a second retaining means integrally formed with the proximal end of the outer tubular member for retaining second ends of the plurality of strands; and (e) a ring sleeve member rotatably installed on the proximal section of the outer tubular member and having a plurality of spaced apart interior spiral grooves, where one of the plurality of interior spiral grooves engages with the spiral ridge such that the sleeve member travels upwardly along the spiral ridge from a lower position to an upper position to allow the inner tubular member, the outer tubular members and the mop head to rotate for disentangling the plurality of strands of the mop head.

Defined broadly, the present invention is a mop apparatus for unwinding the tangled strands of a mop head which is made from a plurality of strands, the apparatus comprising: (a) an elongated inner tubular member having a proximal section with a proximal end and a distal section with a distal end; (b) a first retaining means attached to said proximal end of said inner tubular member for retaining first ends of said plurality of strands; (c) an outer tubular member slidably installed over said proximal section of said inner tubular member and having a proximal section with a proximal end, a distal handle section, and an elongated spiral groove integrally formed on the proximal section and extending downwardly from a midsection to the proximal end; (d) a second retaining means integrally formed with said proximal end of said outer tubular member for retaining second ends of said plurality of strands; and (e) a ring sleeve member rotatably installed on said proximal section of said outer tubular member and having a plurality of spaced apart interior spiral ridges, where one of the plurality of interior spiral ridges engages with said spiral groove such that the sleeve member travels upwardly along said spiral groove from a lower position to an upper position to allow said inner tubular member, said outer tubular member and said mop head to rotate for disentangling said plurality of strands of said mop head.

Defined more broadly, the present invention is a mop apparatus for unwinding the tangled strands of a mop head which is made from a plurality of strands, the apparatus comprising: (a) an inner tubular member having a proximal section with a proximal end and a distal section with a distal end; (b) a first retaining member attached to the proximal end of the inner tubular member for retaining first ends of the plurality of strands; (c) an outer tubular member slidably installed over the proximal section of the inner tubular member and having a proximal section with a proximal end, a distal section, and a spiral guide means formed on the proximal section and extending downwardly from a midsection to the proximal end; (d) a second retaining member formed to the proximal end of the outer tubular member for retaining second ends of the plurality of strands; and (e) a sleeve member rotatably installed on the proximal section of the outer tubular member and having at least one corresponding interior spiral guide means, where the at least one corresponding interior spiral guide means engages with the spiral guide means of the outer tubular member such that the sleeve member travels upwardly along the spiral guide means of the outer tubular member from a lower position to an upper position for allowing the inner tubular member, the outer tubular member and the mop head to rotate for disentangling the plurality of strands of the mop head.

Defined even more broadly, the present invention is a mop apparatus for unwinding the tangled strands of a mop head which is made from a plurality of strands, the apparatus comprising: (a) an inner tubular member having means for retaining first ends of the plurality of strands of the mop head; (b) an outer tubular member slidably installed over the inner tubular member and having means for retaining second ends of the plurality of strands of the mop head, and further having mating guide means; and (c) a sleeve member rotatably installed on the outer tubular member and having at least one corresponding mating guide means, where the at least one corresponding mating guide means engages with the mating guide means of the outer tubular member such that the sleeve member travels upwardly along the mating guide means of the outer tubular member for allowing the inner tubular member, the outer tubular member and the mop head to rotate for disentangling the plurality of strands of the mop head; (d) whereby a user holds the sleeve member so that the inner tubular member, the outer tubular member and the mop head start rotating, the rotational movement of the mop head disentangles the plurality of strands from each other, by allowing the sleeve member to travel upwardly along the mating guide means of the outer tubular member.

Defined again even more broadly, the present invention is a mop apparatus for unwinding the tangled strands of a mop head which is made from a plurality of strands, the apparatus comprising: (a) an inner tubular member having a proximal section with a proximal end and a distal section with a distal end; (b) a first retaining member attached to said proximal end of said inner tubular member for retaining first ends of said plurality of strands; (c) an outer tubular member slidably installed over said proximal section of said inner tubular member and having a proximal section with a proximal end, a distal section, and a spiral guide means formed on the proximal section and extending downwardly from a midsection to the proximal end; (d) a second retaining member formed to said proximal end of said outer tubular member for retaining second ends of said plurality of strands; and (e) a sleeve member rotatably installed on said proximal section of said outer tubular member and having at least one corresponding interior spiral guide means, where the at least one corresponding interior spiral guide means engages with said spiral guide means of said outer tubular member such that the sleeve member travels upwardly along said spiral guide means of said outer tubular member from one position to another position for allowing said inner tubular member, said outer tubular member and said mop head to rotate for disentangling said plurality of strands of said mop head.

Of course the present invention is not intended to be restricted to any particular form or arrangement, or any specific embodiment disclosed herein, or any specific use, since the same may be modified in various particulars or relations without departing from the spirit or scope of the claimed invention hereinabove shown and described of which the apparatus shown is intended only for illustration and for disclosure of an operative embodiment and not to show all of the various forms or modifications in which the present invention might be embodied or operated.

The present invention has been described in considerable detail in order to comply with the patent laws by providing full public disclosure of at least one of its forms. However, such detailed description is not intended in any way to limit the broad features or principles of the present invention, or the scope of patent monopoly to be granted.

What is claimed is:

1. A mop apparatus for unwinding the tangled strands of a mop head which is made from a plurality of strands, the apparatus comprising:

a. an elongated inner tubular member having a proximal section with a proximal end and a distal section with a distal end;

b. a first retaining means attached to said proximal end of said inner tubular member for retaining first ends of a plurality of strands of a mop;

c. an outer tubular member slidably installed over said proximal section of said inner tubular member and having a proximal section with a proximal end, a distal handle section, and an elongated spiral ridge integrally formed on the proximal section and extending downwardly from a midsection to the proximal end;

d. a second retaining means integrally formed with said proximal end of said outer tubular member for retaining second ends of said plurality of strands; and e. a ring sleeve member rotatably installed on said proximal section of said outer tubular member and having a plurality of spaced apart interior spiral grooves, where one of the plurality of interior spiral grooves engages with said spiral ridge such that the sleeve member travels upwardly along said spiral ridge from a lower position to an upper position to allow said inner tubular member, said outer tubular member and said mop head to rotate for disentangling said plurality of strands of said mop head.

2. The apparatus in accordance with claim 1 wherein said distal handle section has a plurality of exterior knurls for gripping thereto.

3. The apparatus in accordance with claim 1 wherein said ring sleeve member further comprises a plurality of exterior knurls so that said ring sleeve member can be grabbed and moved upward by the motion of a user's hand.

4. A mop apparatus for unwinding the tangled strands of a mop head which is made from a plurality of strands, the apparatus comprising:

a. an elongated inner tubular member having a proximal section with a proximal end and a distal section with a distal end;

b. a first retaining means attached to said proximal end of said inner tubular member for retaining first ends of a plurality of strands of a mop;

c. an outer tubular member slidably installed over said proximal section of said inner tubular member and having a proximal section with a proximal end, a distal handle section, and an elongated spiral groove integrally formed on the proximal section and extending downwardly from a midsection to the proximal end;

d. a second retaining means integrally formed with said proximal end of said outer tubular member for retaining second ends of said plurality of strands; and e. a ring sleeve member rotatably installed on said proximal section of said outer tubular member and having a plurality of spaced apart interior spiral ridges, where one of the plurality of interior spiral ridges engages with said spiral groove such that the sleeve member travels upwardly along said spiral groove from a lower position to an upper position to allow said inner tubular member, said outer tubular member and said mop head to rotate for disentangling said plurality of strands of said mop head.

5. The apparatus in accordance with claim 4 wherein said distal handle section has a plurality of exterior knurls for gripping thereto.

6. The apparatus in accordance with claim 4 wherein said ring sleeve member further comprises a plurality of exterior knurls so that said ring sleeve member can be grabbed and moved upward by the motion of a user's hand.

7. A mop apparatus for unwinding the tangled strands of a mop head which is made from a plurality of strands, the apparatus comprising:

a. an inner tubular member having a proximal section with a proximal end and a distal section with a distal end;

b. a first retaining member attached to said proximal end of said inner tubular member for retaining first ends of a plurality of strands of a mop;

c. an outer tubular member slidably installed over said proximal section of said inner tubular member and having a proximal section with a proximal end, a distal section, and a spiral guide means formed on the proximal section and extending downwardly from a midsection to the proximal end;

d. a second retaining member formed to said proximal end of said outer tubular member for retaining second ends of said plurality of strands; and e. a sleeve member rotatably installed on said proximal section of said outer tubular member and having at least one corresponding interior spiral guide means, where the at least one corresponding interior spiral guide means engages with said spiral guide means of said outer tubular member such that the sleeve member travels upwardly along said spiral guide means of said outer tubular member from a lower position to an upper position for allowing said inner tubular member, said outer tubular member and said mop head to rotate for disentangling said plurality of strands of said mop head.

8. The apparatus in accordance with claim 7 wherein said distal section of said outer tubular member further comprises a gripping handle.

9. The apparatus in accordance with claim 8 wherein said gripping handle has a plurality of exterior knurls for gripping.

10. The apparatus in accordance with claim 7 wherein said sleeve member further comprises a plurality of exterior knurls so that said sleeve member can be grabbed and moved upward by the motion of a user's hand.

11. The apparatus in accordance with claim 7 wherein said spiral guide means of said outer tubular member is a spiral ridge.

12. The apparatus in accordance with claim 11 wherein said at least one corresponding interior spiral guide means of said sleeve member is a spiral groove.

13. The apparatus in accordance with claim 7 wherein said spiral guide means of said outer tubular member is a spiral groove.

14. The apparatus in accordance with claim 13 wherein said at least one corresponding interior spiral guide means of said sleeve member is a spiral ridge.

15. A mop apparatus for unwinding the tangled strands of a mop head which is made from a plurality of strands, the apparatus comprising:

a. an inner tubular member having means for retaining first ends of a plurality of strands of a mop head;

b. an outer tubular member slidably installed over said inner tubular member and having means for retaining second ends of said plurality of strands of said mop head, and further having mating guide means; and c. a sleeve member rotatably installed on said outer tubular member and having at least one corresponding mating guide means, where the at least one corresponding mating guide means engages with said mating guide means of said outer tubular member such that the sleeve member travels upwardly along said mating guide means of said outer tubular member for allowing said inner tubular member, said outer tubular member and said mop head to rotate for disentangling said plurality of strands of said mop head.

16. The apparatus in accordance with claim 15 wherein said outer tubular member further comprises a handle section with a plurality of exterior knurls for gripping thereto.

17. The apparatus in accordance with claim 15 wherein said sleeve member comprises a plurality of exterior knurls so that said sleeve member can be grabbed and moved along the outer tubular member by the motion of a user's hand.

18. The apparatus in accordance with claim 15 wherein said mating guide means of said outer tubular member is a spiral ridge.

19. The apparatus in accordance with claim 18 wherein said at least one corresponding mating guide means of said sleeve member is a spiral groove.

20. The apparatus in accordance with claim 15 wherein said mating guide means of said outer tubular member is a spiral groove.

21. The apparatus in accordance with claim 20 wherein said at least one corresponding mating guide means of said sleeve member is a spiral ridge.

22. A mop apparatus for unwinding the tangled strands of a mop head which is made from a plurality of strands, the apparatus comprising:

a. an inner tubular member having a proximal section with a proximal end and a distal section with a distal end;

b. a first retaining member attached to said proximal end of said inner tubular member for retaining first ends of a plurality of strands of a mop;

c. an outer tubular member slidably installed over said proximal section of said inner tubular member and having a proximal section with a proximal end, a distal section, and a spiral guide means formed on the proximal section and extending downwardly from a midsection to the proximal end;

d. a second retaining member formed to said proximal end of said outer tubular member for retaining second ends of said plurality of strands; and e. a sleeve member rotatably installed on said proximal section of said outer tubular member and having at least one corresponding interior spiral guide means, where the at least one corresponding interior spiral guide means engages with said spiral guide means of said outer tubular member such that the sleeve member travels upwardly along said spiral guide means of said outer tubular member from one position to another position for allowing said inner tubular member, said outer tubular member and said mop head to rotate for disentangling said plurality of strands of said mop head.

23. The apparatus in accordance with claim 22 wherein said distal section of said outer tubular member further comprises a gripping handle.

24. The apparatus in accordance with claim 23 wherein said gripping handle has a plurality of exterior knurls for gripping.

25. The apparatus in accordance with claim 22 wherein said sleeve member further comprises a plurality of exterior knurls so that said sleeve member can be grabbed and moved upward by the motion of a user's hand.

26. The apparatus in accordance with claim 22 wherein said spiral guide means of said outer tubular member is a spiral ridge.

27. The apparatus in accordance with claim 26 wherein said at least one corresponding interior spiral guide means of said sleeve member is a spiral groove.

28. The apparatus in accordance with claim 22 wherein said spiral guide means of said outer tubular member is a spiral groove.

29. The apparatus in accordance with claim 28 wherein said at least one corresponding interior spiral guide means of said sleeve member is a spiral ridge.

* * * * *